United States Patent [19]

Kowalik et al.

[11] Patent Number: 4,562,420

[45] Date of Patent: Dec. 31, 1985

[54] TIME DELAY FUSE

[75] Inventors: Joseph W. Kowalik, Skokie; David J. Krueger, Arlington Heights, both of Ill.

[73] Assignee: Littelfuse, Inc., Des Plaines, Ill.

[21] Appl. No.: 599,757

[22] Filed: Apr. 13, 1984

[51] Int. Cl.[4] ..... H01H 71/20; H01H 85/04

[52] U.S. Cl. ..... 337/165; 337/164

[58] Field of Search ..... 337/165, 164, 163, 166

[56] References Cited

U.S. PATENT DOCUMENTS

| | | | |
|---|---|---|---|
| 2,293,953 | 8/1942 | Taylor | 337/165 |
| 2,613,297 | 10/1952 | Laing | 337/165 |
| 4,321,574 | 3/1982 | Pertici | 337/165 |

*Primary Examiner*—Harold Broome

*Attorney, Agent, or Firm*—Russell E. Hattis

[57] ABSTRACT

A time delay fuse comprises an initially open end insulating housing having conductive terminals at the opposite ends thereof, a current-heatable strip connected to one of said terminals, a thermal mass in heat communication with the current-heatable strip and a coil spring and current shunt strip electrically coupled between the current-heatable strip and the other terminal to complete a circuit between the terminals. A heat meltable solder connection is located between said thermal mass and the coil spring and current shunt strip, the spring and current shunt strip being spring urged away from the thermal mass so that upon the melting of the heat meltable solder connection the coil spring and current shunt strip will be pulled away from the thermal mass to break the physical and electrical connection of the coil spring and current shunt strip with the current-heatable strip. The current-heatable strip, thermal mass, coil spring and current shunt strip form a sub-assembly insertable as an untensed unit into an initially open end of the fuse housing before the associated terminal is applied thereto. The coil spring and current shunt strip are suspended from the initially open end of the housing and the rest of the sub-assembly is pushed axially inward thereof to stretch the coil spring. The housing is then deformed permanently inward to engage a portion of the sub-assembly to hold the coil spring in its stretched condition.

13 Claims, 13 Drawing Figures

TIME DELAY FUSE

TECHNICAL FIELD OF INVENTION

The most important application of the invention is in time delay ferrule-type fuses which give both short circuit protection and a time delayed protection under prolonged modest overloading currents. These fuses commonly have current ratings of from as small as 1/10th of an amp to as much as 30 amps, although the most important application of the invention is in the higher amperage fuses as, for example, in the range from about 10–30 amps.

BACKGROUND OF INVENTION

Time delay ferrule-type fuses commonly have heretofore comprised a cylindrical housing of insulating material having ferrule or cup-shaped terminal extending over the initially open outer ends of the cylindrical housing. Connected between these terminals within the housing are a series of longitudinally spaced elements including current-heatable, short circuit protection means, a thermal mass in heat communication with the current-heatable means, and a current overload heat-meltable connection between the thermal mass and an adjacent electrical portion of the fuse placed under spring tension. When the thermal mass accumulates sufficient heat under a modest overload (e.g. 135% overload) to melt the heat meltable connection, the spring force pulls the connection apart quickly to separate current-carrying portions of the fuse. In prior art fuses, the housing was divided commonly into a pair of outermost, sand or powder-filled, short circuit protection element-containing compartments and a central, time delay overload protection element-containing compartment. These compartments were generally defined by fiber washers spaced from the end terminals and press-filled into the housing. The central compartment generally contained the thermal mass and a conductive element connected through an overload current heat meltable connection.

These three-compartment fuses had a number of disadvantages. First of all, it was mistakenly believed that adequate dielectric strength for short circuit protection required a pair of powder or sand-filled, short circuit element containing compartments. For this reason and because of the design of the elements of the central time delay overload protection element-containing compartment these fuses comprised an undue number of elements, many of which required hand assembly operations. Also, the positions of the fiber washers sometimes shifted causing clearance spaces through which the sand or powder in the outermost compartments leaked into the central compartment.

As will appear, the present invention provides a fuse where the number of parts and solder connections are materially reduced from that required in that the 3-compartment fuse. More importently, the elements within the fuse are designed and related so that they can be assembled by entirely automated equipment. Also, the unique design of the invention forms a more reliable fuse.

SUMMARY OF THE INVENTION

In accordance with one of the features of the invention, because it was discovered that a single sand-filled compartment was adequate for reliable short circuit protection, the preferred ferrule-type fuse design is comprised of only two compartments, one being a short circuit protection element-containing compartment and the other being a time delay overload protection element-containing compartment. These two compartments are preferably separated and sealed by the thermal mass which is closely enveloped by a central portion of the fuse housing. In addition to its partitioning and thermal mass-forming functions, the thermal mass preferably forms an electrical connecting link between the heat-generating, short circuit protection means in the sand filled compartment and the spring and current-carrying means in the other compartment.

In accordance with another feature of the invention, substantially all of the elements of the fuse within the housing form a separate sub-assembly. The spring portion of this sub-assembly is initially in a completely untensed state, which contributes to the ease of assembly and handling of the sub-assembly before it is inserted into the fuse housing. One end of the sub-assembly is draped over an open end of the housing and then pushed more fully into the housing to place the spring portion of the sub-assembly under a predetermined tension. Before the force on the sub-assembly is released, the housing is preferably crimped into interlocking engagement with a part of the sub-assembly, such as the thermal mass, to permanently fix the spring tension until a prolonged modest overload condition causes the spring and current-carrying means to separate from the thermal mass.

Other features of the invention deal with specific details of construction of various parts of the sub-assembly and their relationship to the housing. Some of these details facilitate the assembly of the parts of the sub-assembly as well as the mounting of the sub-assembly within the housing. Accordingly, certain aspects of the invention deal with the steps involved in such assembly which thus constitute a method aspect of the invention.

DESCRIPTION OF EXEMPLARY EMBODIMENT OF THE INVENTION SHOWN IN THE DRAWINGS

Figure 1:
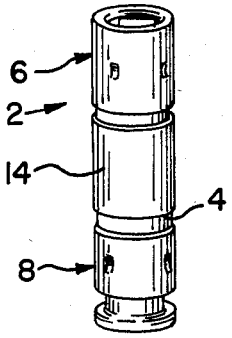
FIG. 1 is a perspective view of a time delay fuse, the interior of which is designed in accordance with the present invention.
Figure 2:
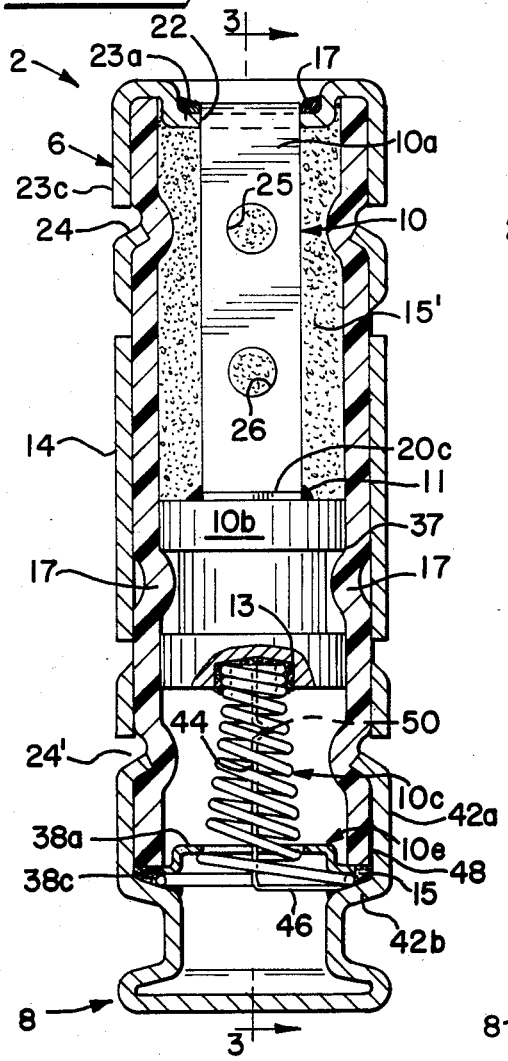
FIG. 2 is a greatly enlarged vertical sectional view through the fuse of claim 1.
Figure 3:
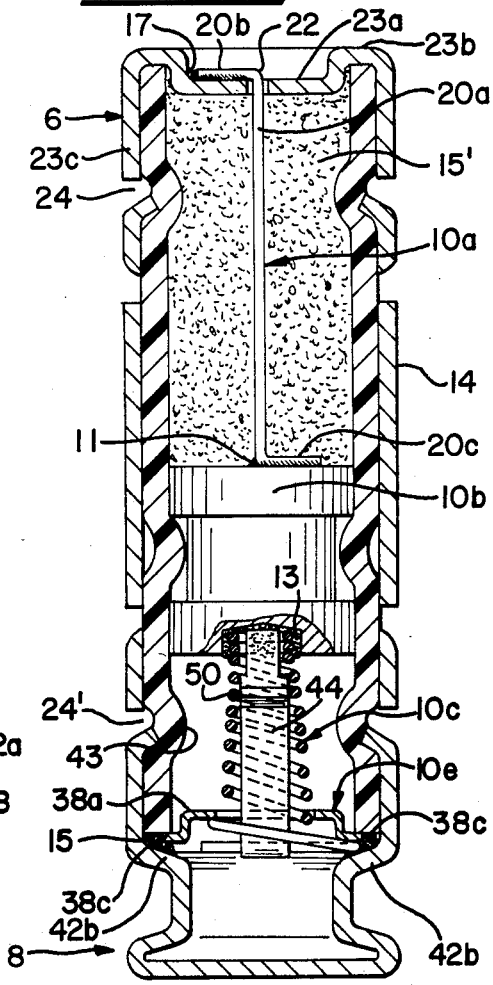
FIG. 3 is a vertical sectional view through the fuse shown in FIG. 2, taken along section lines 3—3 therein.

Referring now to FIGS. 1-3, the ferrule-type time delay fuse 2 there shown includes an open-ended cylindrical insulating housing 4 which may be made of a vulcanized fiber or other suitable insulating material enclosed at its ends by end cap terminals 6 and 8. Physically and electrically connected between the end cap terminals 6 and 8 within the housing 4 is an an all-metal subassembly 10. This sub-assembly includes a current heatable fuse strip 10A made of copper or the like, secured to one end of a metal thermal mass-forming member 10B through a solder joint 11, a coil spring 10C through which extends a current shunt strip 10D secured by a heat meltable solder connection 13 to the other end of the thermal mass-forming member 10D, and a spring support washer 10E. The melting temperature of the solder connection 13 is lower than that of any other solder joint used in the fuse. The thermal mass-forming member 10D is closing enveloped by the central portion of the housing 4 to separate the housing into a sealed compartment **12*a* filled with arc-quenching sand 15' or other suitable arc-quenching material from a compartment containing the coil spring 10C and current shunt strip 10D (sometimes referred to as a spring and current-carrying means in the claims). The position and maximum tension of the coil spring 10C is maintained in an expanded condition by the spring support washer 10E which overlaps one end of the housing 4. A label strip 14 made of paper or the like upon which is printed information concerning the current rating of the fuse and other information is adhesively secured around the center portion of the housing 4**.

Figure 4:
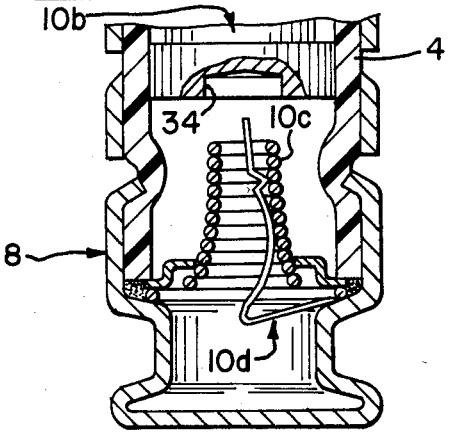
FIG. 4 is a fragmentary sectional view through the bottom portion of the fuse shown in FIG. 2 where a prolonged overload has blown the fuse.

When a short circuit current flows through the fuse, high resistance portions of the strip 10A formed by cross section-reducing aperatures 25-26 will melt. Any resulting arc which develops is quenched by the sand 15'. For prolonged overload currents, for example, currents of a magnitude of 500% of rated current, the current heatable fuse strip 10A will heat up to gradually increase the temperature of the thermal mass-forming member 10B. Finally after a period of time, for example about 10 seconds, this accumulated heat will melt the heat meltable solder connection 13 securing the current shunt strip 10D and the coil spring 10C to the thermal mass-forming member **10*b* and the resultant collapsing of the coil spring will pull with it the current shunt strip 10D because of its unique shape to be described. This blown condition of the fuse is shown in FIG. 4**.

Now that all of the elements of the fuse have been introduced, the specific constructional details of each of the elements can now be described.

The end cap terminal 6 has an outer cylindrical portion **23*c* which is staked at 24 to the insulating housing 4. One of the ends of the current heatable fuse strip 10A is bent to extend along the recessed central portion 23*a* of the end cap terminal 6 and is connected thereto by a solder joint 17. The strip 10A then passes through an opening 22 in the end cap terminal and the main body portion thereof extends longitudinally through the sand-filled compartment 12*a* where it terminates in a transverse leg 20*c* connected by the solder joint 11 to one of the end faces of the thermal mass-forming member 10B**.

Figure 10:
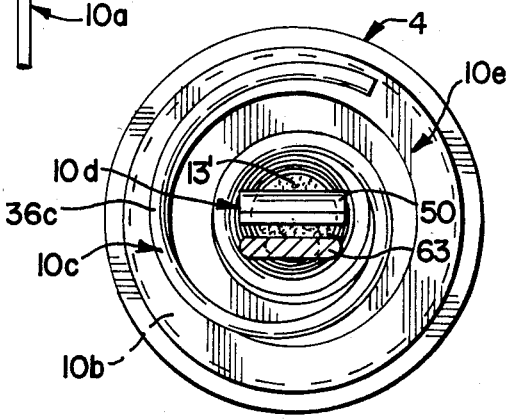
FIG. 10 is a view looking down into the wide end of the coil spring as viewed in the viewing plane 10—10 in FIG. 9, to show the relationship between an offset portion of the current shunt strip and the turns of the coil spring.

The current shunt strip 10D has a narrow end portion 52 extending into a well 34 of the thermal mass-forming member 10B. This narrow end portion joins a wider main body portion 44 to form shoulders **52*a*—52*a* thereat. The narrow end portion 52 of the strip 10D extends within the narrow outer end portion 36*a* of the coil spring 10C, so that when the coil spring collapses upon overload the narrow end 36*a* of the coil spring 10*c* will engage the shoulders 52*a*—52*a* to aid in pulling the current shunt strip 10D away from the thermal mass-forming member 10B. However, to minimize the possibility that the spring will slip around the shoulders 52*a*—52*a* and not be effective in pulling the strip 10D substantially away from the thermal mass-forming member 10B, a laterally offset portion 50 is formed in the main body portion 44 of the strip 10D. This offset portion 50 rigidifies the strip 10D and forms a shoulder against which the coil turns on the inner side thereof can bear, so that the collapsing coil spring 10C will surely pull the strip 10D substantially away from the thermal mass-forming member 10B. FIG. 10 best shows the position of the laterally extending portion 50 of the strip 10D relative to the narrower coil spring turns there beyond which will engage this offset portion upon collapse of the spring 10C**.

A section of the wide end portion of the spring 10C passes through the opening **36*b* in the spring support washer 10F. As best shown in FIGS. 2 and 3 the largest turn of the spring sandwiched between the flange 38*c* of the washer 10E and inwardly extending wall portion 42*b* of the end cap terminal 8. The last two turns of the coil spring are confined against much expansion by the center portion 38*a* of the washer so that the spring has maximum rigidity for a given length thereof. Also, the position of the coil spring is stablized by the washer 10F and upon collapse of the spring, it will not catch the inwardly projecting portion 43 of the housing 4 caused by the staking at 24' of the end cap terminal 8 to the housing 4**.

As best shown in FIG. 2, an outer end portion 46 of the current shunt strip 10D extends laterally outwardly and then terminating in a reversely extending portion 48 sandwiched between the end of the housing 4 and the cylindrical portion **42*a* of the end cap terminal 8. Part of the solder joint 15 thereat extends into the small space between the end of the housing 4** and the end cap terminal.

Figure 5:
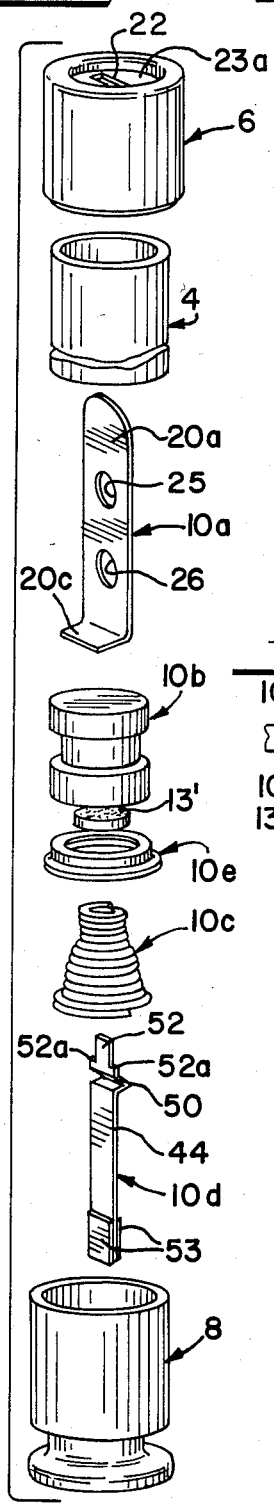
FIG. 5 is an exploded view of the different parts making all metal sub-assembly mounted as a unit within the fuse housing shown in FIG. 1.
Figure 6:
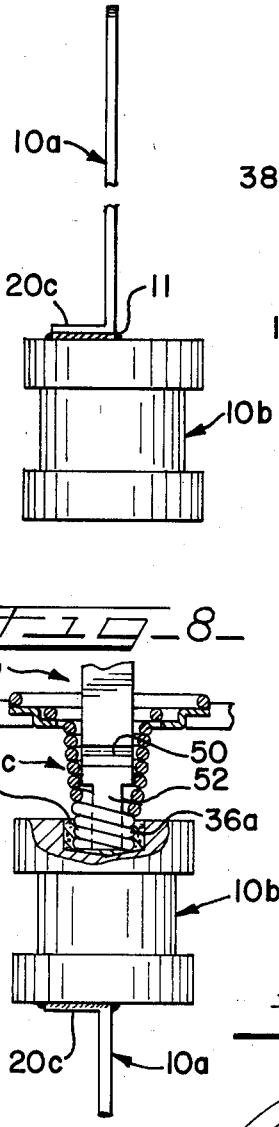
FIG. 6 shows the first step in the initial assembly of the current heatable fuse strip portion of the sub-assembly with the thermal mass-forming member thereof.
Figure 7:
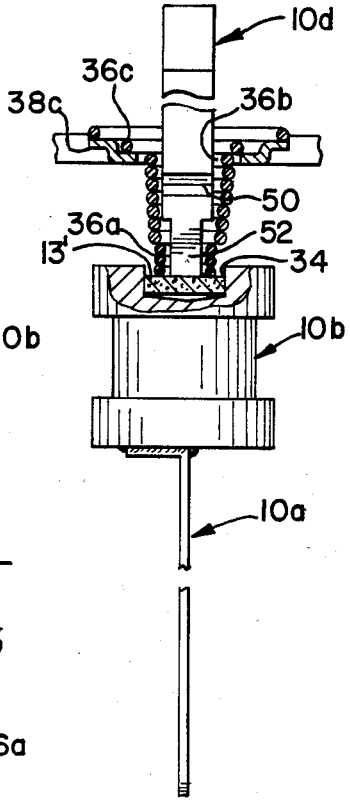
FIG. 7 shows the initial step in the assembly of the coil spring and current shunt strip portions of the sub-assembly within a solder pellet-containing well of the thermal mass-forming member.
Figure 8:
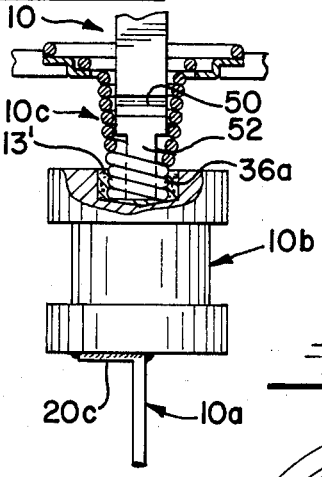
FIG. 8 is a view corresponding to FIG. 7 where the solder pellet has been melted and the bottom end portion of the coil spring and current shunt strip has settled into the bottom of the well where the solder has secured the same to the thermal mass-forming member.

The manner in which the different parts of the fuse are assembled will now be described. As shown in FIG. 5, initially the leg **20*c* of the current heatable fuse strip 10A is seated upon a flat piece of solder cream 11 which is melted as the current heatable fuse strip 10A is pressed down against the end face of the thermal mass-forming member 10B. Next, the thermal mass-forming member 10B is inverted from the position shown in FIG. 5 so that the well 34 therein faces upwardly. As shown in FIG. 7, a solder pellet 13' placed in the bottom of the well 34 is engaged by the narrow end portions 52 and 50***a* of the current shunt strip 10D and the coil spring 10C respectively. The assembly is then heated so that the strip 10D and the coil spring 10C will by pressure or gravity pressed down into the melting solder and engage the inner defining wall of the well 34. The solder 13 then fills the well 34 and forms a low resistance connection between the coil spring 10C, current shunt strip 10D and the thermal mass-forming member 10B, as shown in FIG. 8. Prior to this soldering operation, the coil spring 10C is passed through the spring washer 10E, which then becomes a permanent part of the resulting sub-assembly 10, which is to be placed within the fuse housing 4.

Figure 9:
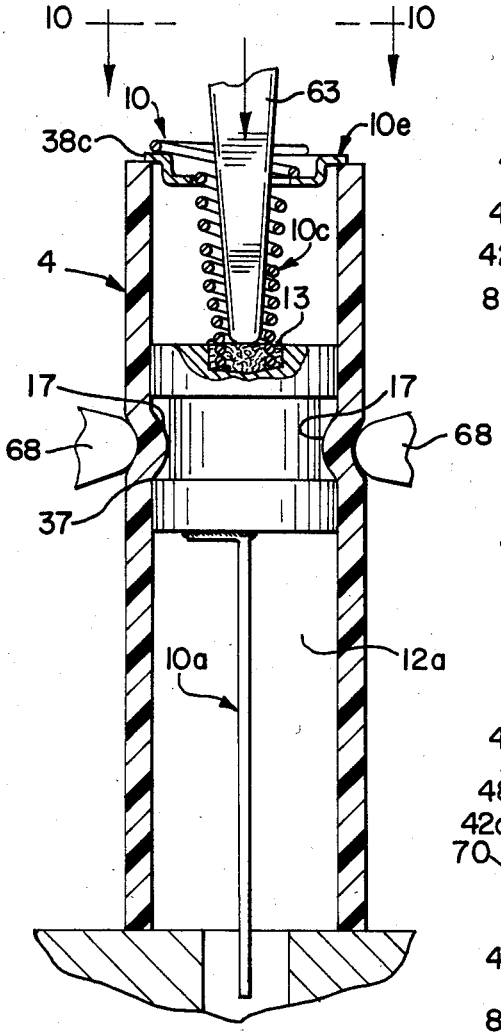
FIG. 9 illustrates the manner in which the completed sub-assembly shown in FIG. 8 is suspended from an open-end insulating housing of the fuse and depressed to expand the coil spring, the tension in the spring being fixed by staking the housing into an annular recess in the thermal mass-forming member.

Refer now to FIG. 9 which shows the manner in which the finished sub-assembly 10 is mounted within a fuse housing 4. As there shown, the housing 4 is initially stably supported in any suitable manner in a vertical direction so that the sub-assembly 10 can be dropped into place within the housing 4 with the flange 38*c* of the spring support washer 10E resting on the outer end surface 40 of the housing 4. Then, a suitable tool 63 placed upon the hardened body of solder 13 of the well 34 is pushed downwardly to stretch the coil spring 10C a desired amount. At this point, the outer end of the current heatable fuse strip 10A has not been bent laterally to form the leg 20*b* to be secured to the end face 23*a* of the end cap terminal 6. The degree of expansion of the coil spring is fixed by multiple tools like 68 which compress the vulcanized fiber housing 4 inwardly to form dimples 17 which engage the edge 37 of the thermal mass-forming member 10B. The enlarged end portions of the thermal mass-forming member 10B are tightly engaged by the walls of the housing 4 so that the member 10B forms a barrier which prevents the migration of any sand from the compartment 12*a* to the opposite end of the housing 4.

Figure 11:
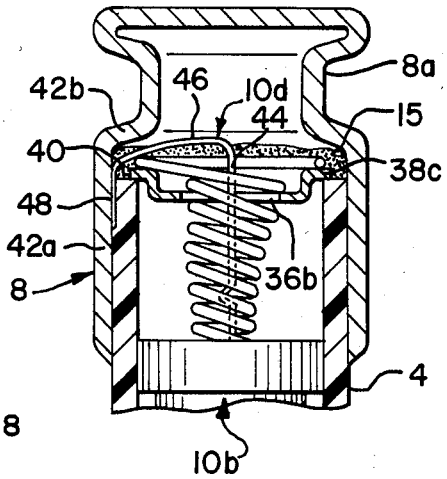
FIGS. 11 and 12 respectively illustrate the initial and final steps of assembly of one of the end cap terminals of the fuse with the end of the insulating housing.
Figure 12:
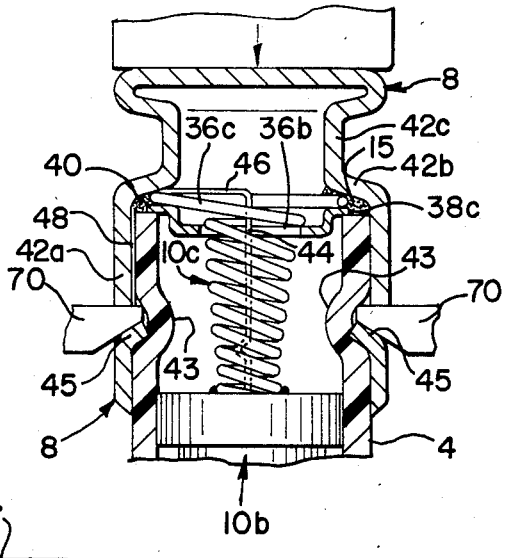

The final assembly of the fuse involves applying the end cap terminals 6 and 8 to the ends of the housing and filling the compartment 12*a* with sand before the end cap terminal 6 is so applied. Referring now to FIG. 11, the end cap terminal 8 which has an annular recessed portion 8*a* therein is placed on the inner surface of the end cap wall 42*b* before the end cap terminal 8 is positioned over the housing. Then, as shown in FIG. 12, the end terminal is pushed downwardly while the end cap terminal is heated so that the solder paste 15 melts and is forced in the space between the cylindrical portion 42*a* of the end cap terminal 8 and the housing 4. Prior to the application of the end cap terminal 8 to the housing 4, the outer end 48 of the current shunt strip 10D is placed over the outside of the housing 4 to be captured between the end cap terminal 8 and the housing 4 when the terminal is placed over the housing. The end 48 of the current shunt strip 10D is initially tinned at 53 (FIG. 5) to facilitate the soldering operation. Staking tools 70—70 secure the terminal in place by staking portions of the end cap terminal into the housing wall (FIG. 12).

Figure 13:
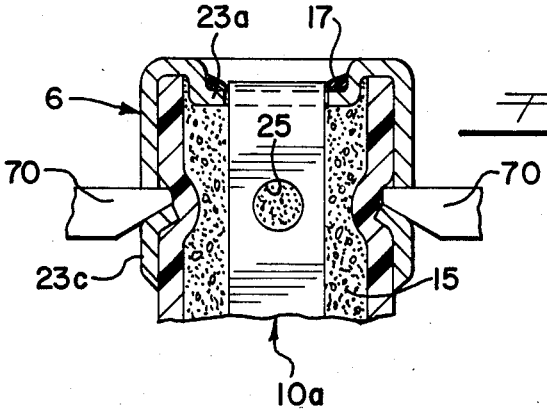
FIG. 13 shows the assembly of the other end cap terminal to the other end of the housing.

Finally, the other end cap terminal 6 is applied to the other end of the housing as shown in FIG. 13. Thus, after the end cap terminal 6 has been placed over the housing, the straight end of the current-heatable fuse strip 10A is bent over the recessed central portion 23*a* of the end cap terminal 6 where it is soldered in place by the solder joint 17. Prior to the soldering operation, the end cap terminal 6 is staked onto the end of the housing 4, as previously explained.

Since the basic sub-assembly 10 of the invention described is an all metal unit where the spring 10C remains in its unstressed state until assembled within the housing, the various assembly operations described can be readily automated. Also, since all of the sub-assembly parts are made of metal they are not sensitive to the temperatures which may be required during the soldering operation, unlike many of the designs of the prior art which include fiber washers and require many hand assembly operations. Finally, the resultant fuse construction is an extremely reliable construction.

It should be understood that numerous modifications may be made in the most preferred form of the invention described without deviating from the broader aspects of the invention.

We claim:

1. In a time delay fuse comprising an initially open end insulating housing having conductive terminals at the opposite ends thereof, current-heatable means connected to one of said terminals, a thermal mass in heat communication with said current-heatable means, spring and current- carrying means electrically coupled between said current-heatable means and the other terminal to complete a circuit between said terminals, and a heat meltable connection between said thermal mass and said spring and current-carrying means, said spring and current-carrying means being spring urged away from said thermal mass so that upon the melting of said heat meltable connection said spring and current-carrying means will be pulled away from said thermal mass to break the physical and electrical connection of said spring and current-carrying means with said current-heatable means, the improvement wherein said current-heatable means, thermal mass and spring and current-carrying means form a sub-assembly insertable as an untensed unit into an initially open end of said housing before the associated terminal is applied thereto, said spring and current-carrying means being anchored to said initially open end of said housing and the rest of the sub-assembly being pushed axially inward thereof to stretch a spring portion of said spring and current-carrying means, said spring and current-carrying means comprises a longitudinally extending conductive strip surrounded by a longitudinally extending coil spring which is said spring portion, the ends of said strip being connected respectively to said other terminal and to said thermal mass through said meltable connection, spring tension retaining means engaging with said sub-assembly to hold said coil spring in its stretched conditions, and said conductive strip having an axially inwardly facing shoulder adjacent to which a turn of said coil spring is located so that upon collapse of said spring the spring will pull said strip away from said thermal mass.

2. In a time delay fuse comprising an initially open end insulating housing having conductive terminals at the opposite ends thereof, current-heatable means connected to one of said terminals, a thermal mass in heat communication with said current-heatable means, spring and current-carrying means electrically coupled between said current-heatable means and the other terminal to complete a circuit between said terminals, and a heat meltable connection between said thermal mass and said spring and current-carrying means, said spring and current-carrying means comprises a longitudinally extending conductive strip surrounded by a longitudinally extending coil spring which is said spring portion, the ends of said strip being connected respectively to said other terminal and to said thermal mass through said meltable connection, and said conductive strip has a laterally offset portion opposite a turn of said coil spring on the side thereof facing said thermal mass, wherein upon the melting of said meltable connection the collapsing coil spring can engage said laterally offset portion of said strip to pull said conductive strip away from said thermal mass.

3. The time delay fuse of claim 1 or 2 wherein said thermal mass forms at least part of an electrical and physical connection between said current heatable means and said conductive strip.

4. The time delay fuse of claim 1 or 2 wherein said coil spring is a conically shaped coil spring, the wide end of which is adjacent to an end of said housing.

5. In a time delay fuse comprising an initially open end insulating housing having conductive terminals at the opposite ends thereof, current-heatable means connected to one of said terminals, a thermal mass in heat communication with said current-heatable means, spring and current-carrying means electrically coupled between said current-heatable means and the other terminal to complete a circuit between said terminals, and a heat meltable connection between said thermal mass and said spring and current-carrying means, said spring and current-carrying means comprises a longitudinally extending conductive strip surrounded by a longitudinally extending coil spring which is said spring portion, the ends of said strip being connected respectively to said other terminal and to said thermal mass through said meltable connection, spring tension retaining means engaging with said sub-assembly to hold said coil spring in its stretched condition, and said conductive strip has an axially inwardly facing shoulder adjacent to which a turn of said coil spring is located, and said strip also has a laterally offset portion opposite a turn of said coil spring on the side thereof facing said thermal mass, wherein upon the melting of said meltable connection the collapsing coil spring can engage said shoulder and if it slips by or deforms said shoulder it still engages said laterally offset portion of said strip to pull said conductive strip away from said thermal mass.

6. In a time delay fuse comprising an initially open end insulating housing having conductive terminals at the opposite ends thereof, current-heatable means connected to one of said terminals, a thermal mass in heat communication with said current-heatable means, spring and current-carrying means electrically coupled between said current-heatable means and the other terminal to complete a circuit between said terminals, and a heat meltable connection between said thermal mass and said spring and current-carrying means, said spring and current-carrying means comprises a longitudinally extending conductive strip surrounded by a longitudinally extending coil spring which is said spring portion, the ends of said strip being connected respectively to said other terminal and to said thermal mass through said meltable connection, and spring tension retaining means engaging with said sub-assembly to hold said coil spring in its stretched condition, and the end of said coil spring adjacent said other terminal is captured by a spring end capturing means which keeps the spring centered and overlaps the adjacent end portion of said housing to maintain the tension in said coil spring in cooperation with said spring tension retaining means.

7. In a time delay fuse comprising an initially open end insulating housing having conductive terminals at the opposite ends thereof, current-heatable means connected to one of said terminals, a thermal mass in heat communication with said current-heatable means, spring and current-carrying means electrically coupled between said current-heatable means and the other terminal to complete a circuit between said terminals, and a heat meltable connection between said thermal mass and said spring and current-carrying means, said spring and current-carrying means comprises a longitudinally extending conductive strip surrounded by a longitudinally extending coil spring which is said spring portion, the ends of said strip being connected respectively to said other terminal and to said thermal mass through said meltable connection, and said thermal mass is a rigid metal body which is engaged by the inner walls of said housing along a continuous area enveloping the mass so that it forms sealed compartments on opposite sides thereof, and there being in the compartment on the side thereof including said current-heatable means an arc quenching material which substantially fills the compartment.

8. In a time delay fuse comprising an initially open end insulating housing having conductive terminals at the opposite ends thereof, current-heatable means connected to one of said terminals, a thermal mass in heat communication with said current-heatable means, spring and current-carrying means electrically coupled between said current-heatable means and the other terminal to complete a circuit between said terminals, and a heat meltable connection between said thermal mass and said spring and current-carrying means, said spring and current-carrying means comprises a longitudinally extending conductive strip surrounded by a longitudinally extending coil spring which is said spring portion, the ends of said strip being connected respectively to said other terminal and to said thermal mass through said meltable connection, and said thermal mass is a rigid metal body having an annular recess therearound, and said spring tension retaining means being inwardly extending means projecting into said annular recess.

9. In a time delay fuse comprising an initially open end insulating housing having conductive terminals at the opposite ends thereof, current-heatable means connected to one of said terminals, a thermal mass in heat communication with said current-heatable means, spring and current-carrying means electrically coupled between said current-heatable means and the other terminal to complete a circuit between said terminals, and a heat meltable connection between said thermal mass and said spring and current-carrying means, said spring and current-carrying means comprises a longitudinally extending conductive strip surrounded by a longitudinally extending coil spring which is said spring portion, the ends of said strip being connected respectively to said other terminal and to said thermal mass through said meltable connection, and said thermal mass is a solid body filling a portion of said housing, said solid body having a well in the central portion of one end of said body, said coil spring being a conical dashed shape spring having a wide end and a narrow end and the inner end of said conductive strip and said narrow end of said coil spring extending into said well, said well containing a heat meltable material forming said heat meltable connection.

10. In a time delay fuse comprising an initially open end insulating housing having conductive terminals at the opposite ends thereof, current-heatable means connected to one of said terminals, a thermal mass in heat communication with said current-heatable means, spring and current-carrying means electrically coupled between said current-heatable means and the other terminal to complete a circuit between said terminals, and a heat meltable connection between said thermal mass and said spring and current-carrying means, said spring and current-carrying means being spring urged away from said thermal mass so that upon the melting of said heat meltable connection said spring and current-carrying means will be pulled away from said thermal mass to break the physical and electrical connection of said spring and current-carrying means with said current-heatable means, the improvement wherein said spring and current-carrying means comprises a longitudinally extending conductive strip surrounded by a longitudinally extending coil spring, the ends of said strip being connected respectively to said other terminal and to said thermal mass through said meltable connection, said conductive strip having a laterally offset portion opposite a turn of said coil spring on the side thereof facing said thermal mass, wherein upon the melting of said meltable connection the collapsing coil spring can engage said laterally offset portion of said strip and pull said strip away from said thermal mass.

11. The time delay fuse of claim 10 wherein the spring is a conical spring with the wide end thereof adjacent said other terminal of said fuse, said turn of said coil spring having a smaller opening than the space occupied by said laterally offset portion of said strip, the inner end of said strip and the narrow end of said coil spring being releasably held in position by said heat meltable connection upon said thermal mass until said connection melts upon a prolonged overload.

12. The time delay fuse of claim 11 wherein said thermal mass is a solid body filling a portion of said housing, said solid body having a well in the central portion of one end of said body, and the inner end of said conductive strip and the narrow end of said coil extending into said well, said well containing a heat meltable material forming said heat meltable connection.

13. In a time delay fuse comprising an initially open end insulating housing having conductive terminals at the opposite ends thereof, current-heatable means connected to one of said terminals, a thermal mass in heat communication with said current-heatable means, spring and current-carrying means electrically coupled between said current-heatable means and the other terminal to complete a circuit between said terminals, and a heat meltable connection between said thermal mass and said spring and current-carrying means, said spring and current-carrying means being spring urged away from said thermal mass so that upon the melting of said heat meltable connection said spring and current-carrying means will be pulled away from said thermal mass to break the physical and electrical connection of said spring and current-carrying means with said current-heatable means, the improvement wherein said spring and current-carrying means includes a longitudinally extending coil spring, and spring turn capturing means which positions and prevents inward movement of the outer end of said spring, and said spring turn capturing means is a washer member having a central opening into which the outer end portion of said spring extends, the outermost turn of the spring being larger than said washer opening, said washer having a flange extending over the end of said housing, and said other terminal having an inwardly extending portion which holds the washer flange against an end portion of said housing.

* * * * *